United States Patent [19]

Johnson

[11] Patent Number: 4,726,591

[45] Date of Patent: Feb. 23, 1988

[54] MULTIPLE TYPE TARGET GAME

[76] Inventor: Clyde R. Johnson, R.D. #1, Box 481, Port Allegany, Pa. 16743

[21] Appl. No.: 922,294

[22] Filed: Oct. 20, 1986

[51] Int. Cl.[4] ..... A63B 67/02; A63B 67/06

[52] U.S. Cl. ..... 273/339; 273/176 B; 273/181 A; 273/338; 273/402; 273/415; 273/425

[58] Field of Search ..... 273/339, 336, 338, 415, 273/424, 425, 428, 176 B, 181 R, 181 A, 402

[56] References Cited

U.S. PATENT DOCUMENTS

| | | | |
|---|---|---|---|
| 626,328 | 6/1899 | Kroscher et al. | 273/338 |
| 2,626,152 | 1/1953 | Miller | 273/176 B |
| 3,386,736 | 6/1968 | Fong | 273/338 |
| 3,628,793 | 12/1971 | Mudloff | 273/415 X |
| 3,837,650 | 9/1974 | Haney | 273/415 X |
| 3,856,298 | 12/1974 | Frantti | 273/402 X |
| 3,980,305 | 9/1976 | Breslow et al. | 273/391 |
| 4,129,298 | 12/1978 | Richardson et al. | 273/339 |

FOREIGN PATENT DOCUMENTS

| | | | |
|---|---|---|---|
| 23051 | 11/1914 | United Kingdom | 273/339 |

*Primary Examiner*—William H. Grieb
*Attorney, Agent, or Firm*—Richard L. Miller

[57] ABSTRACT

A recreational game device which may be used indoor or outdoor for use with playing several skill games. Targets are located on the game device and are used for playing various games.

2 Claims, 5 Drawing Figures

24
34
36
12
10
11
14
16
18

10
11
4
12
38
34
20
40
28
26
14
16
18
4

11
12
10
34
30
14
16
18

32
20
36
12
38
11
34
10
16
42
40

32
22
20
10
36
11
34
12

MULTIPLE TYPE TARGET GAME

BACKGROUND OF THE INVENTION

This invention relates to a recreational game device and more particularly to an indoor/outdoor game apparatus for use in the playing of several skill games.

Numerous conventional games have been provided in the prior art that are adapted to play use. For example, U.S. Pat. Nos. 3,628,793; 3,856,298; and 3,980,305 all are illustrative of such prior art. While these units may be suitable for the particular purpose to which they address, they are not the same and would not be as suitable for the purposes of the present invention as heretofore described.

SUMMARY OF THE INVENTION

It is therefore a primary object of the present invention to provide a recreational skill game device that will overcome the shortcomings of the prior art devices.

Another object is to provide a recreational skill game device which permits the user to practice several skill games using the one device.

A further object is to provide a recreational game device which is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DESCRIPTION OF THE PREFERRED EMBODIMENTS

Figure 1:
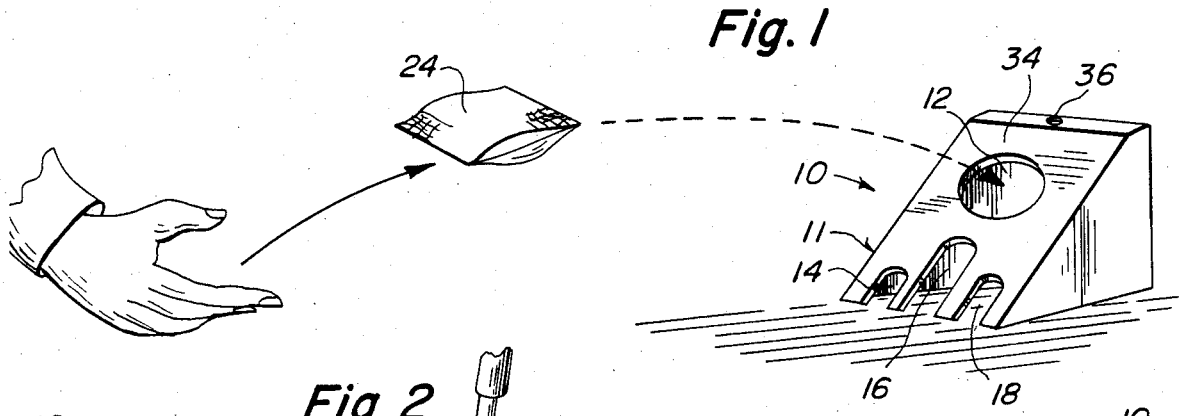
FIG. 1 is a perspective of the invention shown in use for playing a game of tossing bean bags.

Turning now descriptively to the drawings, in which similar reference characters denote similar elements throughout the several views, FIGS. 1 through 5 illustrate a recreational game of skill device generally illustrated by numeral 10.

The recreational game of skill device 10, has a housing 11, which is of a prism shape and has targets 12, 14, 16, 18, 20, and 22 on its front face 34.

As seen in FIG. 1, bean bag 24 can be tossed into circular target opening 12.

Figure 2:
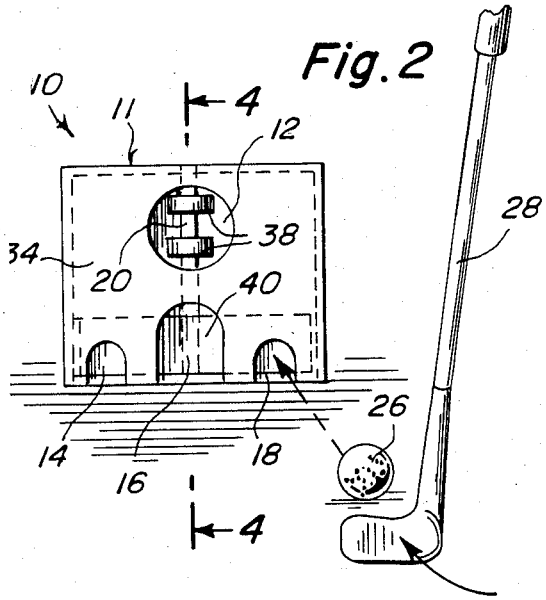
FIG. 2 is a front elevational view thereof showing the game played with balls.

In FIG. 2, it is seen that golf ball 26, can be struck into small arch shaped targets 14 or 18 using club 28.

Figure 3:
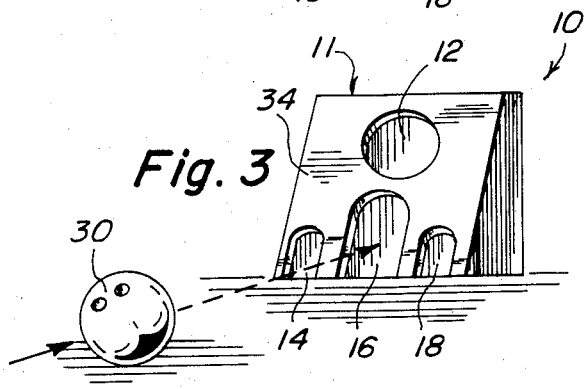
FIG. 3 is a perspective view thereof illustrating a bowling ball game.

As seen in FIG. 3, bowling ball 30, can be rolled into large arch shaped target 16.

Figure 4:
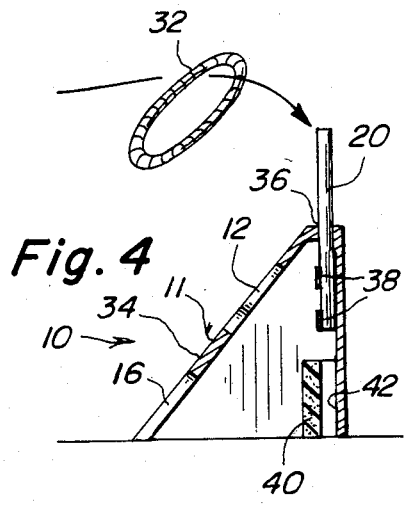
FIG. 4 is a cross sectional view taken on line 4—4 of FIG. 2 the instant invention played in a ring toss game.

In FIG. 4, ring 32 can be thrown over peg targets 20 or 22; or either of the two. Peg target 20 may be frictionally pivoted upward or downward so that when the user desires to use the peg target 20 it may be slided frictionally through brackets 38 and out of slot 36 so that now a user of the game can aim at it; when it is desired to use another of the targets, peg target 20 may be frictionally slid downward into said slot 36 and through said brackets 38 into a back stop (resilient pad) 40 which has cavity 42 to receive the peg target.

Figure 5:
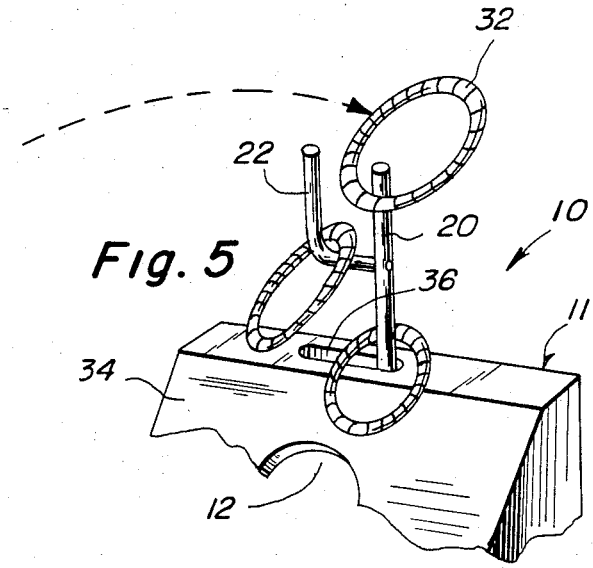
FIG. 5 is a fragmentary perspective view of the invention showing a modified design of the ring toss post that is forked so that if a ring encircles both prongs the player's score is doubled; the post being adjustable for a single prong playing.

FIG. 5 shows peg target 20 having a second appendage 22 attached thereto which can be frictionally pivoted downward so as to allow exclusive use of said peg target 20. In any given game either peg target 20 or its appendage 22 may be used or both.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A recreational game of skill comprising:

(a) a housing having a front sloping face having a multiplicity of openings through which various projectiles may be directed;

(b) a peg shaped target frictionally slidable into said housing; and (c) a multiplicity of rings sized to fit over said peg shaped target when tossed by a user, wherein a back stop resilient pad is attached on a rear wall in side of said housing opposite said front sloping face, and a cavity formed within said pad to permit a portion of said peg shaped target to reside there in when said peg shaped target is stored inside of said housing.

2. A recreational game of skill as recited in claim 1 wherein said peg shaped target has frictionally pivotable appendage attached thereto.

* * * * *